United States Patent [19]

Casamassima

[11] Patent Number: 4,991,123

[45] Date of Patent: Feb. 5, 1991

[54] ALARM SYSTEM

[75] Inventor: Mario D. Casamassima, Mansfield, Mass.

[73] Assignee: Cerberus A.G., Maennedorf, Switzerland

[21] Appl. No.: 293,999

[22] Filed: Jan. 6, 1989

[51] Int. Cl.[5] ..... G08B 25/00

[52] U.S. Cl. ..... 364/550; 340/525; 340/825.08; 340/825.1; 340/825.11

[58] Field of Search ..... 340/525, 577, 825.08, 340/825.1, 825.11; 364/141, 550

[56] References Cited

U.S. PATENT DOCUMENTS 3,665,461 5/1972 Gnägi et al. ..... 340/577 X
4,359,721 11/1982 Galvin et al. ..... 340/525
4,423,410 12/1983 Galvin et al. ..... 340/525
4,491,828 1/1985 Galvin et al. ..... 340/525
4,751,498 6/1988 Shalvi et al. ..... 340/525 X
4,803,469 2/1989 Matsushita ..... 340/577
4,831,558 5/1989 Shoup et al. ..... 364/550

*Primary Examiner*—Parshotam S. Lall
*Assistant Examiner*—Edward R. Cosimano
*Attorney, Agent, or Firm*—Wolf, Greenfield & Sacks

[57] ABSTRACT

The invention is a control system comprising a plurality of sensor units, a plurality of output units, and a central processing unit coupled via a data/address bus. Each peripheral unit, i.e. sensor unit or output unit, includes an EEPROM, the Op-code protocol of which is used to provide all addressing and data protocol necessary to support system communication over the bus.

29 Claims, 7 Drawing Sheets

ALARM SYSTEM

FIELD OF THE INVENTION

The invention relates to control systems for organizing data transfer between remote peripheral devices. More particularly, the invention relates to communication protocol between a centralized processing unit and remote sensors and output units such as are found in a Local Area Network (LAN).

BACKGROUND OF THE INVENTION

Any control system can be thought of as consisting of three blocks. The first block is the monitoring or sensor unit which monitors the environment for specific events or conditions. The monitoring unit may be as simple as a manual switch or as complex as a computer system. The second block is the processing block wherein data from the monitoring devices is assimilated and programming is performed on the data to prepare the system for response to the indicated conditions from the monitoring devices. The third block comprises an output device which receives instructions from the processing unit and responds thereto. The output device may comprise an alarm, microcomputer, relay, etc.

In a fire alarm system for an office building for example, the monitoring devices may comprise "call boxes", "pull down" stations, heat sensors or smoke detectors. The processing unit might comprise a central computer for monitoring and controlling the entire system. The output devices might comprise alarm speakers, bells, sprinklers or, in more complex systems, a CRT screen and a computer for displaying pertinent information about the alarm condition.

The output of the monitoring or sensor unit, may be as simple as a binary Active/Inactive bit or may be a quantized output containing specific information about the conditions at the sensors such as the actual temperature. The sensor's output signal is the input information to the processing unit. The processing unit obtains the input data and performs a predetermined algorithm upon it. The end results of the algorithm are signals to the output devices.

A very small system might have all three blocks contained in the same physical enclosure. However, as the size of the system increases, the number of sensor units and output units increases. Typically in an alarm type system, the number of sensor units will increase at a faster rate than the number of output units.

There are several different methods by which communication between the separate blocks of a large system can be accomplished. One manner would be to have an input line to the processing unit from each sensor and an output line to each output device. This method, however, quickly becomes extremely expensive in terms of wiring cost and in the amount of circuitry or processing ability needed at the processing unit to support the input and output devices. This method would also make it extremely difficult to expand without considerable expense.

A more effective method which has been used in the past is to serially connect the sensor units on a single wire or set of wires. Typically, the processing unit determines the identification of the sensor with which it is communicating based on the position of the sensor in the serial lineup. There are quite a number of methods for preventing the sensors from "talking" simultaneously on the line. The output devices are coupled to the central processing unit in the same serial type connection and communicate therewith in a similar manner. This type of system, however, also has several substantial drawbacks. First, since it is typically only the sensor's position in the serial lineup which allows the processing unit to determine which sensor it is communicating with, complex wiring is required and must be performed perfectly in order for the system to operate. Further, it is cumbersome to add or delete sensors from this type of system because it would require updating of memory tables within the processing unit. Thirdly, in this type of system it is not possible to individually address a specific sensor. Each time a sensor must be monitored, the entire input loop must be read by the microprocessor. Likewise, each time an output unit must be read from or written to, the processing unit must loop through a different programming routine. This seriously diminishes the system response time.

Probably the most effective method of connecting the separate blocks of a control system having a large number of sensor units and output units is by use of an address and/or data bus. In this type of system, all sensor units and output units can be coupled to a single bus and communicate with the processing unit thereover. Each sensor unit and output unit is assigned a unique address which is sent to or from the processing unit in combination with data so as to earmark any communications for the desired sensor or output device to which it is directed. A device detecting its address can then read in the data and respond thereto while the remaining devices will not interfere with the communications of the bus between the accessed device and the processing unit.

Although more effective than the separate wiring scheme or serial scheme discussed above, the address bus method still has several drawbacks relating to the addressability of each sensor. The problems fall into two categories; (1) the need to provide some method to set the addresses of the sensors, and (2) the need for a substantial amount of intelligence at the sensor to handle the addressing protocol.

In relation to the first problem, the most inexpensive manner of setting an address for each sensor interface is to provide thin traces or jumpers on the printed circuit board etch. The traces can be cut into the PC thereby setting the address. The disadvantages of this technique, however, include the fact that the pattern of jumpers to support a large number of addresses becomes very confusing to the installer. Further, it is very difficult to correct a mistake or change a device address at a later date.

Another method which eliminates the problems related to the use of printed circuit board etching comprises replacing the jumpers with a DIP switch or an encoded switch. The switch allows the address to be easily set or changed. The encoding of the switch would provide a decimal visual indication to the installer, rather than the binary code of the DIP switch. However, switches are not inexpensive and are subject to vibration, oxidation, corrosion and tampering, all of which can undesirably change the sensor's address. Further, the switches are physically large.

Another alternative would be to use a fusable link PROM (programmable read only memory) or an EPROM (erasable programmable read only memory) to hold the address. These devices would be mounted on the circuit board associated with the sensor in a manner so that they could be easily removed in order to allow reprogramming and/or verification of the device. If and when it becomes necessary to change an address of a device, in the case of a PROM, it would have to be discarded and replaced with a new one. An EPROM on the other hand would have to be removed, erased, reprogrammed, and then replaced on the circuit board. An EEPROM (electrically erasable programmable read only memory) may also be used in a similar fashion to an EPROM.

As stated, intelligence must be supplied at the sensor and output devices to handle the addressing. The earliest methods of providing a sensor with the intelligence necessary to recognize when it was being addressed involved very complex state machines. A state machine would be designed using dozens of electronic components which would determine when one addressing sequence had finished and synchronize itself for a subsequent addressing sequence. The state machine would then compare the address transmitted over the bus with the address set on the jumpers, switches or PROM. If the address matched, it would then transfer control to another hardware section which would output the data requested from the sensor by the processing unit. More recently, the state machine has been replaced in the sensors by a custom made chip having the dozens of component embodied therein.

Another alternative along the same lines is to provide a general purpose microcontroller at each sensor which can be used, along with a specific software algorithm, to handle the addressing protocol.

In all of the situations discussed above (discrete hardware, custom chip, microcontroller), local intelligence must be provided at the sensor in order to enable the sensor to handle the addressing protocol of the control system. All of these methods require additional components for handling the address setting and addressing protocol. These components also consume additional power.

Therefore, it is an object of the present invention to provide an improved control system.

It is a further object of the present invention to provide a control system capable of handling a large number of both sensor units and output units with minimal intelligence at the sensor units and output units.

SUMMARY OF THE INVENTION

The invention is a control system for monitoring specified conditions at remote locations and reacting thereto. The invention is preferably employed for use as an alarm system such as a fire alarm system for a home or office building having, (1) multiple sensor stations for determining when an alarm condition (fire) exists, (2) a central processing unit for assimilating and operating on data from the sensors, and (3) a multiplicity of output units (e.g. alarms or sprinklers etc.), controlled by the processing unit, for responding to the conditions observed by the sensor units. The control system of the present invention utilizes the protocol of a serial EEPROM as its addressing protocol. Instead of devising a proprietary communications protocol to connect devices to the data bus and providing local intelligence at each sensor unit and output unit to conduct the protocol communications, the serial protocol which activates the EEPROM is used to provide all addressing protocol necessary to support the system.

Each sensor unit and output unit is provided with an interface card equipped with an EEPROM for coupling the given unit with the address/data bus of the system. The processing unit and all sensor units and output units are coupled to a single bus over which all system communication is provided. An EEPROM is employed as a memory storage device and comprises a group of memory locations divided into a series of registers. For example, a 1K bit EEPROM (1024 bit locations) may be divided into sixty-four addressable registers having sixteen bits each. In a serial EEPROM having these characteristics, an instruction op-code is received at the data input pin of the EEPROM (e.g. READ) followed by the register addresses to which the op-code pertains. After the op-code and address are received, the EEPROM responds by performing the requested operation (e.g. serially outputting the 16 bits of information in the addressed register).

The unique implementation of the addressing protocol of the present invention will now be described. Initially, a block of data in the EEPROM is set aside for addressing of peripheral devices such as the sensor and output units. This block of data contains at least as many bits as there are peripheral devices in the system. Each EEPROM associated with a peripheral device is programmed so that, for example, a "zero" is stored in every bit location in an address block except one in which a "one" is stored. Each EEPROM has the one stored in a unique location. Addressing protocol ca be implemented using only the address data block of memory and the built-in protocol of the EEPROMS.

The processing unit sends an instruction over the data bus which is seen by all units on the address/data bus, and which instructs the EEPROMS that the processing unit is requesting to read a specific register. In response to the instruction, all EEPROMS respond simultaneously so that the processing unit should receive, on the bus, sixteen consecutive current pulses representing "ones". In this manner, the processing unit can determine whether a unit is operational and properly connected to the address/data bus. For instance, if the processing unit receives a zero in the $n^{th}$ bit position, it would know that the $n^{th}$ sensor unit was not operating properly.

In addition, in the case of sensor units, the addressing scheme of the present invention provides a low cost means for reading the condition of the sensing device at each sensor unit. As will be described more fully in the Detailed Description of the Invention, the clock signal, sensing device output signal, and data out signal of the EEPROM can be combined before being placed on the bus such that during the clock cycle corresponding to the reading out of the bit set to 1, half of the clock cycle is reserved for reporting of the unit (i.e., is it present on the bus) and the other half can be reserved for reporting of the sensing device (alarm or no alarm).

In the case of output units, the addressing scheme of the present invention provides a simple and low cost means for providing response instructions to them. Each response device, such as an alarm, is coupled to the associated EEPROM as well as to the bus through a combination circuit that is designed to activate the response device only when the data read out from the EEPROM and the data on the bus are both "ones" simultaneously. An AND gate could serve as the combination circuitry. With such a system, the processing unit can activate any desired output unit by sending a pulse over the bus timed to occur simultaneously with the reading out of the bit set to "one" of the EEPROM associated with the desired output unit.

The invention will be more fully understood from the detailed description below, which should be read in conjunction with the accompanying drawings. This description is presented by way of example only, the invention being defined only by the claims appended to the end of the description.

DETAILED DESCRIPTION

Figure 1:
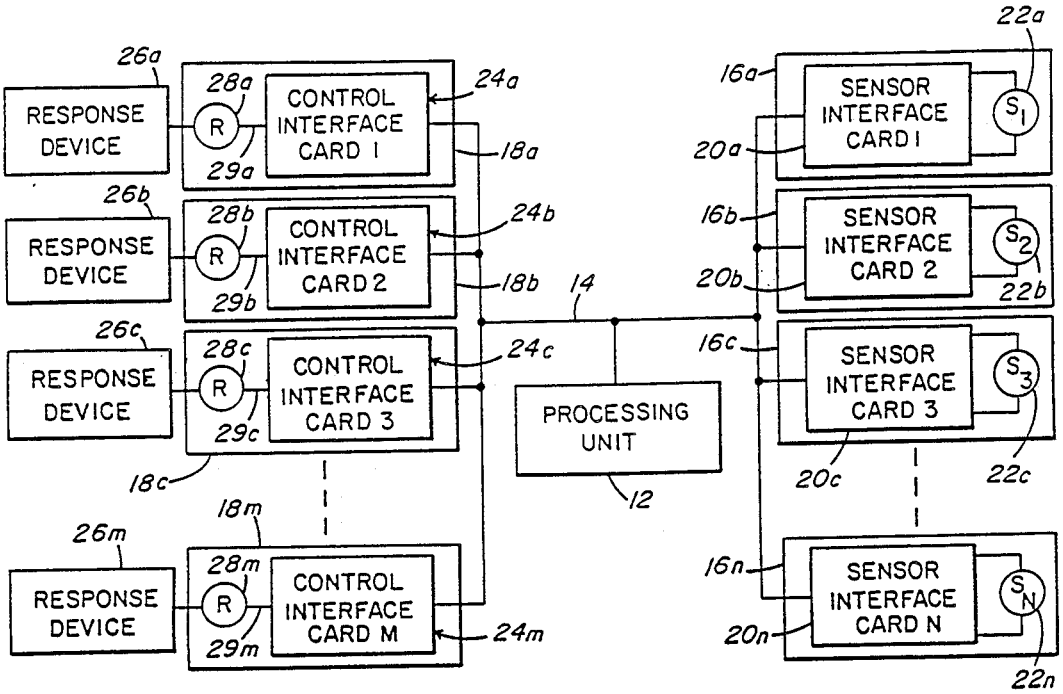
FIG. 1 shows a block diagram of the general system layout of the present invention.

FIG. 1 shows a general block diagram of the control system of the present invention. The centralized processing unit 12 generally comprises a microcomputer which controls all protocol and processing functions of the entire control system. An address/data bus 14 couples the processing unit 12 to all peripheral devices. In general, the peripheral devices comprise two different types of units, sensor units 16*a*–16*n* and control units 18*a*–18*m*. However, it may also include other peripheral units such as display devices, printers, etc. The sensor units include a sensor interface printed circuit card 20*a*–20*n* and a sensing device 22*a*–22*n*. The sensing devices 22 may be manually operated "pull down" switches such as might be found in fire alarm boxes. Alternately, the sensing units might be smoke detectors or heat sensors. Although a pull down switch actually does not monitor environmental conditions, the term sensing device will be used to include any kind of input device for reporting conditions to the processing unit. The sensor interface cards 20*a*–20*n* comprise electronic hardware for interfacing the sensor units 22*a*–22*n* to the address bus 14 in addition to an EEPROM specifically programmed to carry out addressing protocol as will be described shortly.

The output units 18*a*–18*m* comprise a printed circuit card 24*a*–24*m* for interfacing with the bus 14 as well as a response device 26*a*–26*m*. In a fire alarm type control system, the response device might typically be an alarm or possibly one of a series of sprinklers. The alarm or sprinkler typically would be controlled by a relay 28*a*–28*m* coupled to the control interface card 24*a*–24*m* to receive an activate signal over line 29*a*–29*m*. Hereinafter elements 16, 18, 20, 22, 24, 26, 28 and 29 shall be referred to without the accompanying letter designation unless a distinction is being made between the various corresponding elements.

Address/data bus 14 comprises a single conductor for allowing all communication between the processing unit 12 and the peripheral devices 16 and 18. The clock signal, chip select signal, and addressing protocol are sent over bus 14 from the processing unit 12 to the peripheral devices 16 and 18. Further, all data transfers to or from a peripheral device are also carried out over the single communication line of the address/data bus 14.

Figure 2:
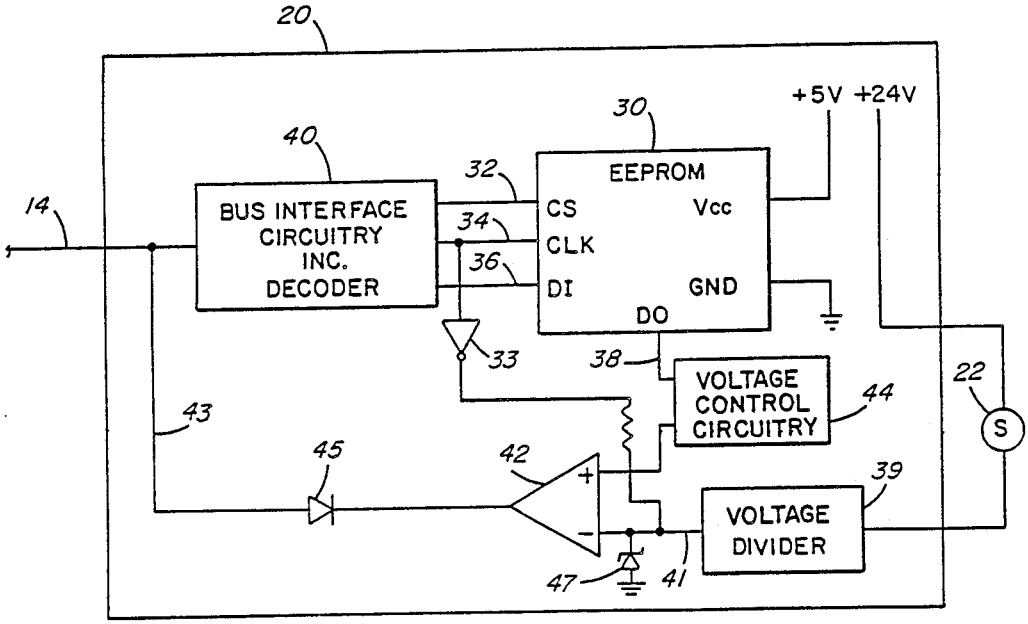
FIG. 2 shows a block diagram of the basic layout of the sensor stations.

FIG. 2 shows a more detailed diagram of the sensor unit 16. The interface card 20 comprises three main sections. The first section is an EEPROM 30. Various EEPROMS are available which are suitable for the purposes of the present invention. As will be discussed shortly, the EEPROMS must have at least as many bits of memory bits as there are peripheral devices. In the preferred embodiment, the 93C46 1K bit serial EEPROM available from Catalyst Semiconductor, Inc. of Santa Clara, Calif. is used. This particular EEPROM is adapted for serial data transfer. The EEPROM is embodied in an 8 pin dual in line (DIP) package. Of concern to the present invention are the chip select input pin 32, the clock input pin 34, the data in pin 36 and the data-out pin 38. Since the communication path of address/data bus 14 comprises a single line, the clock, chip select signal, op-codes for instructing the EEPROM, and data addresses all enter the interface card 20 from the processing unit 12 over the single communication line of the bus 14 in a tri-level coded fashion. Interface circuitry 40 is provided for detecting the three levels of the various incoming signals and decoding them so as to send them to the correct EEPROM input pin. Such decoding circuitry is known in the prior art and will not be discussed in further detail herein.

The sensor units respond to the instructions from the processing unit. The data-out from the data-out pin 38 of the EEPROM 30 is combined with the output of the sensing device 22 through a comparator 42 before being placed on the bus 14. In the embodiment described here, the sensing device 22 may comprise a relay activated by a certain environmental condition, a manually operated switch, or any other two state device.

In the embodiment shown in FIG. 2, the sensing device 22 outputs a high voltage level when in an alarm state, and a low voltage level when inactive. The data-out pin 38 of the EEPROM, is supplied to the non-inverting input of the comparator 42 through voltage control circuitry 44. The output of the sensing device 22 is supplied to the inverting output of the comparator 42 on line 41 through voltage divider 39. Zener diode 47, having a dead band of 4.3 volts is also coupled between the common ground and the inverting input. The comparator 42 can only sink current when the data at its inverting input is at a higher voltage than the data at its non-inverting input. Further, reverse connected diode 45 prevents the comparator 42 from placing any positive current on the bus 14. The clock pulse train is also supplied to the inverting input of comparator 42 through inverter 33. Voltage control circuitry 44 holds the voltage at the non-inverting input of the comparator 42 at 5 volts at all times except when the data on data-out pin 38 is high. When the data at pin 38 goes high, the voltage control circuitry 44 drops the voltage at the non-inverting input to 2.5 volts. As will be explained in greater detail herein, due to the arrangement of voltage control circuitry 44, diode 45, inverter 33 and Zener diode 47, comparator 42 can place no current on the bus 14 until the data from data-out pin 38 goes high. Further, the first half of the clock cycle corresponding to the reading out of the high bit from pin 38 reports the condition of the sensing device 22, while the second half of the clock cycle reports whether the sensor unit 20 is properly coupled to the bus.

Therefore, each sensor unit 16 cannot affect the data on the bus 14 except during the single clock cycle during which the set bit is read out of the associated EEPROM. Further, half of this clock cycle is reserved for reporting of the EEPROM while, the other half of the clock pulse, is reserved for reporting of the sensing device 22.

In other embodiments, the sensing device need not be a two state device but may have any number of output states so as to report qualitative or quantitative information rather than a simple on/off condition. The system can be adapted to accommodate a sensing device having a multi-bit output simply by increasing the number of unique bits set to one in each EEPROM. Each sensing device could then report as many bits of data as there are set bits in the associated EEPROM.

The mode of operation of the present invention will now be described in greater detail. The alarm system of the present invention operates in one of several modes. The two most important modes of operation are the idle mode, in which the processing unit 12 checks if all peripheral devices are operating and checks the sensor units for an alarm condition, and the alarm mode, in which the processing unit notifies the output units that an alarm has been detected and the output units respond thereto. Other modes are also included such a an initialization mode, in which all default conditions are set upon power-up, a test mode in which the peripheral devices can be individually tested, a trouble mode which alerts the operator of any conditions in the system which indicates an improper operation and a program mode in which the EEPROMs and the microprocessor in the processing unit 12 can be programmed. Although the EEPROM is used for addressing in all of these modes, the use of the EEPROM will be described in relation to the alarm mode and the idle mode and it should be understood that it applies to all addressing of peripheral devices in the system. The addressing scheme in all other modes is similar to that described in relation to the idle and alarm modes and should be obvious from the description herein.

For the vast majority of the time, the system will be in the idle mode in which the software in the processing unit 12 constantly executes a single large loop of sub processes so as to continually poll all peripheral devices including the sensor units 16 and the output units 18 to assure the system is operating properly. The addressing protocol of the present invention during polling in the idle mode will be better understood with reference to the timing diagram of FIG. 3 and the register map of FIG. 4. The polling of the sensor units will be described first.

Each of the sensor units 16 is equipped with an EEPROM for implementing addressing protocol between the sensor unit and the processing unit 12. In a preferred embodiment, the 93C46 from Catalyst Semiconductor, Inc. of Santa Clara, Calif. is used. This EEPROM is a 1k bit serial EEPROM arranged into sixty four registers of sixteen bits each. Referring to the register map of FIG. 4, a specified block of memory comprising sixteen registers, termed the sensor addressing memory block, is reserved for addressing of sensor units. As will be described in greater detail shortly, each bit location in this block of memory corresponds to a sensor unit address and therefore the sensor addressing block must have at least as many bits therein as there are sensor units in the system. A system having an EEPROM using the register map of FIG. 4 supports up to 256 (16 registers × 16 bits) sensors. When the system is initially set up, each EEPROM associated with a sensor unit is programmed to have a "one" in a single bit position in the sensor addressing block and a "zero" stored in every other position in the entire EEPROM memory. The bit position that is set in each EEPROM is assigned such that the position of the set bit is unique to each EEPROM.

Figure 3A:
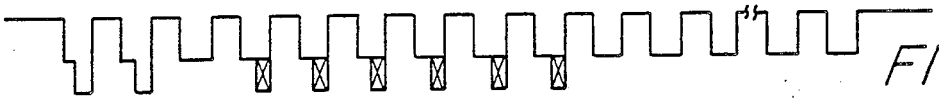
FIGS. 3A, 3B, 3C, 3D and 3E shows timing diagrams of the address protocol on the data bus of the present invention.
Figure 3B:
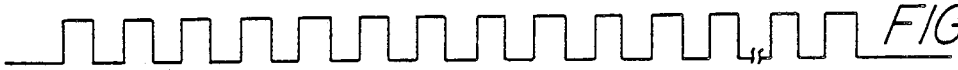
Figure 3C:
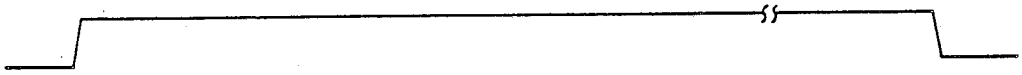
Figure 3D:
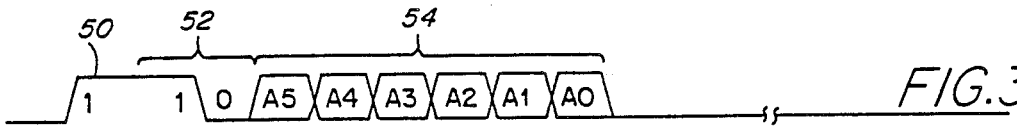
Figure 3E:
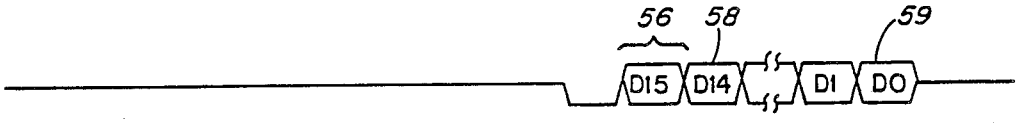

As stated, addressing protocol is accomplished over bus 14 using three states rather than two states. FIG. 3A shows the multiplexed combination of the clock signal, chip select signal and data signal sent from the processing unit 12 over the data bus to the peripheral devices. All peripheral devices coupled to the bus, including sensor units 16 and output units 18, receive the signal. The peripheral units 16 and 18 decode the incoming multiplexed signal into its three components, the clock pulse shown in 3B, the chip select signal shown in 3C and the data signal shown in 3D. FIG. 3E shows the data-out from pin 38 in response to the signal on line 14 as shown in FIGS. 3A, 3B, 3C and 3D. The chip select signal is generated by merely placing a high voltage at the chip select input 32 for the duration of the clock pulse train. The data portion of the incoming signal comprises the serial protocol for the EEPROM (in this case the 93C46 from Catalyst Semiconductor, Inc.). For this particular EEPROM, the data comprises a start bit 50 which alerts the EEPROM that it is about to receive an op-code. The start bit 50 is followed by the two bit op-code 52 which instructs the 93C46 that it is to be READ from. For the 93C46 EEPROM, the op-code for a READ instruction is 10 (binary) as shown in FIG. 3D. The two bit op-code 52 is then followed by a six bit address indicating the register which is to be read from. Six bits are necessary to address the registers since there are 64, i.e. $2^6$, 16 bit registers.

After the acquisition delay of the EEPROM, all peripheral devices on the bus respond simultaneously to the READ instruction. Sensor unit **16*a*, for instance, will respond with a "one" at pin 38 in the first bit position 56 in FIG. 3E. All other peripheral devices, including all other sensor units, should respond with a "zero" at the first bit position 56. Sensor unit 16*b*, for instance, will respond with a "one" in the second bit position 58 in FIG. 3E while all other peripheral devices, including sensor unit 16*a*, should respond with a "zero" in this position. The same situation should hold true up to the sixteenth serial bit 59. Since the outputs of the EEPROMs on pins 38 are combined with the output of the sensing devices 22 through the comparator 42 before being placed on the bus 14, the output of the sensor unit 16 onto the bus 14 is actually a current pulse rather than a voltage pulse. Therefore, the terms "zero output" or "one output" used in relation to pin 38 of an EEPROM refers to a current pulse of a first or second pulse magnitude, respectively. In a preferred embodiment, the first pulse magnitude corresponds to no current and the second pulse magnitude corresponds to a small current drawn into the comparator 42**.

The processing unit reads the data returned on the data bus 14 to determine if the first sixteen sensor units are reporting back and what condition the sensing devices 22 are in. The data from one sensor unit 16 is associated with each clock pulse. The data returned during the first half of each clock pulse contains information concerning the condition of the sensing device 22 at the corresponding sensor unit 16. The data reported during the second half of each clock pulse corresponds to the reporting of the sensor unit 16 as to whether it is properly connected to the bus 14 and operating. Should no current pulse (a zero) appear during the second half of any of the sixteen consecutive clock cycles corresponding to the reading of data on the data bus 14, then the processing unit 12 would know that the sensor corresponding to the received zero is either not functioning or is not properly connected to the bus. For instance, if the processing unit 12 received a zero during the second half of the fourteenth clock pulse corresponding to a READ of the first register, that would indicate that the fourteenth sensor unit is not operating properly. The processing unit 12 READS each register of EEPROM memory in the system once during each idle mode programming loop to determine if all peripheral devices are working properly.

When a sensing device 22 at one of the sensor units is in an alarm condition such that it is producing a high voltage output on line 41, it is allowed to affect the output on line 43 to the bus 14 only during the first half of the clock cycle corresponding to the reading out of the set bit from the EEPROM. The output of comparator 42 is a negative current only when the voltage supplied at the inverting input is higher than the voltage supplied at the non-inverting input. When the voltage at the non-inverting input is higher than the voltage at the inverting input, diode 45 inhibits any output on line 43.

In a preferred embodiment, voltage control circuitry 44 holds the voltage at the non-inverting input of comparator 42 at five volts at all times except when the set bit is read from data-out pin 38. Further, the output of voltage divider 39 when the sensor is activated is approximately sixteen volts, while the output when the sensor is not activated is approximately zero volts. Finally, the output of inverter 33 during the first half of the clock cycle is approximately zero volts while the output during the second half of the clock cycle is approximately 5 volts, i.e. it is the inverse of the clock. Zener diode 47, having a dead band of 4.3 volts, does not allow the voltage at the inverting input of comparator 42 to exceed 4.3 volts regardless of the output of voltage divider 39 or inverter 33. When the data on pin 38 is zero volts, voltage control circuitry 44 holds the non-inverting input of comparator 42 at 5 volts. Regardless of the voltages provided by voltage divider 39 and inverter 33, the voltage at the inverting input of comparator 42 cannot exceed 4.3 volts. Thus, whenever the data-out from pin 38 is zero, the output of comparator 42 is a positive current which is inhibited by diode 45. During the clock cycle corresponding to the reading out of the set bit on pin 38, the output of the comparator 42 depends on the combination of the conditions of the output of voltage divider 39 and inverter 33. During the first half of the clock cycle, when the output of inverter 33 is zero volts, the output of voltage divider 39 will determine the output of comparator 42. When the sensor device is an alarm condition, the output of voltage divider 39 is approximately 16 volts causing the inverting input to go to 4.3 volts. Since 4.3 volts exceeds the 2.5 volts present at the non-inverting input, comparator 42 would output a negative current during the first half of the clock pulse corresponding to the reading out of the set bit on pin 38. If the sensing device 22 is not in alarm condition, the output of voltage divider 39 is zero volts. In this situation, the voltage at the inverting input of comparator 42 is approximately zero while the voltage at the non-inverting input of comparator 42 is 2.5 volts. Therefore, in this situation, the output of comparator 42 is a positive current which is inhibited by diode 45.

During the second half of the clock cycle, the output of inverter 33 is 5 volts, in response to which diode 47 places 4.3 volts at the inverting input of comparator 42. Therefore, regardless of the voltage at the output of voltage divider 39, the inverting input will receive 4.3 volts. Since the 4.3 volts exceeds the 2.5 volts present at the non-inverting input of the comparator, the comparator will sink a current during the second half of the clock cycle regardless of the condition of the sensor 22.

FIG. 5 shows the possible outputs of comparator 42 for the various conditions. FIG. 5A shows the clock pulse present on the bus. FIG. 5B shows the output of the inverter 33 which is the inverted clock signal. FIG. 5C shows the data out from pin 38 which comprises a low voltage level at all times except during one full clock cycle corresponding to the reading out of the set bit. FIG. 5D shows the output of the comparator 42 when an alarm condition exists. FIG. 5E shows the output of comparator 42 when the sensing device is not in alarm condition. As shown in FIGS. 5D and 5E, the output of comparator 42 is high at all times when data out on line 38 is low, regardless of any other condition. Further, when the sensing device is in alarm condition, the output of comparator 42 during the reading out of the set bit is a current pulse into the comparator 42 for the duration of the entire clock pulse. On the other hand, as shown in FIG. 5E, the output of comparator 42 during the reading out of the set bit when there is no alarm condition is a current pulse lasting only half a clock cycle.

Thus a complete addressing scheme can be implemented without the need for intelligence other than the EEPROM memory unit at the sensor unit. The protocol designed into the EEPROMs along with the intelligence at the processing unit can accomplish all addressing protocol. It should be noted that it it is not necessary that each sensor unit be assigned a single bit. Each sensor unit can be assigned as many bits as desired so as to report back more than simply an on/off condition but rather to include some qualitative or quantitative data such as the ambient temperature, smoke content, etc. For instance, eight bits can be reserved for each sensor unit wherein all positions would be assigned a "zero" in each sensor unit except for eight consecutive bit locations which would be set to "ones". The output of the sensor 22 can then be an eight bit word signifying some qualitative or quantitative measurement at the sensor.

Output devices and other peripheral devices are similarly equipped with an EEPROM and bus interface circuitry and are programmed to operate in the same manner. As stated, in the idle mode, the processing unit polls all other peripheral devices in the same manner as was described in relation to the polling of the sensor devices. Of course, the output devices, unlike the sensor units, will report back to the processing unit only that they are either coupled to the bus or not. They will not report back any additional information such as the alarm condition reported by the sensor units. Therefore, for instance, the output units would not contain the comparator 42 and diode 45 but would rather directly place data from the data-out pin of the EEPROM onto the bus.

Figure 4:
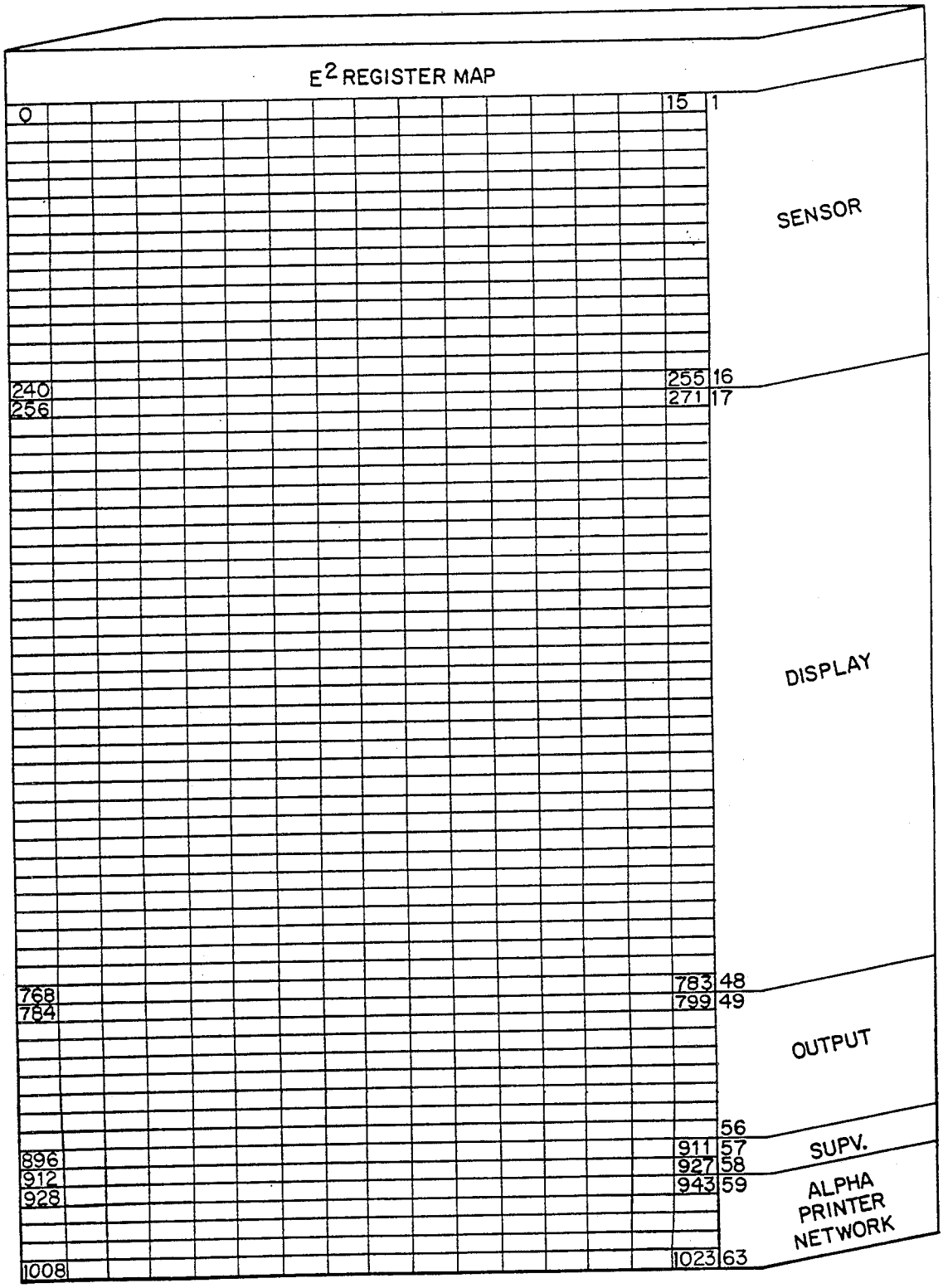
FIG. 4 shows a memory map of the EEPROMS of the present invention.
Figure 5A:
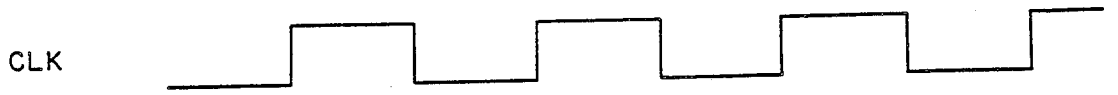
FIGS. 5A, 5B, 5C, 5D and 5E show timing diagrams illustrating reporting of the sensor units of the present invention.
Figure 5B:
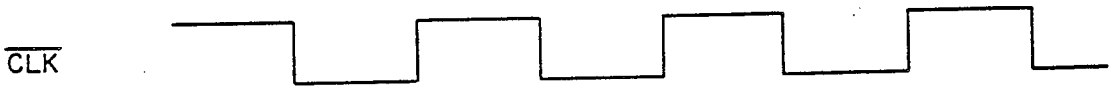
Figure 5C:
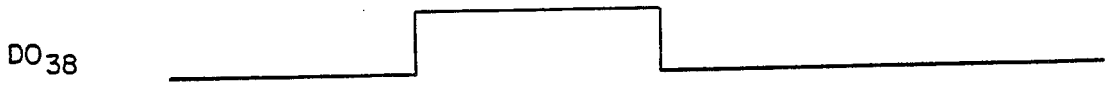
Figure 5D:
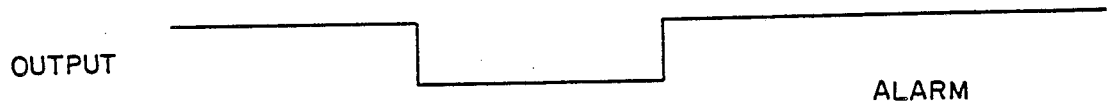
Figure 5E:
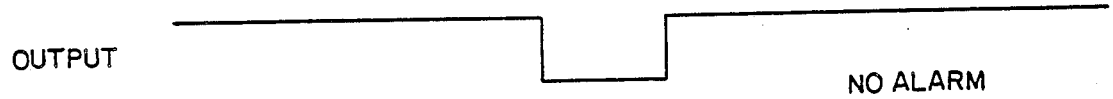

The addressing of other peripheral devices such as display units, printers or the output units can be accomplished in a like manner, as illustrated by FIG. 4. Each peripheral device must be equipped with the same type of EEPROM so that they all have the same size memory and respond to the same op-codes. Further, each peripheral device need merely have one bit position in the EEPROMs reserved for its use. As shown in FIG. 4, the memory space of the EEPROMs is divided into separate blocks for each type of peripheral device. This type of block arrangement is preferred because of its simplicity, however, the memory need not be divided into distinct blocks associated with each type of peripheral device. It is only necessary that each peripheral device have a unique bit location (or locations) which is set to one while all other bit locations are set to zero.

In the register map of FIG. 4, the first block of memory, entitled the sensor block, comprises sixteen registers of sixteen bits each. Therefore, up to 256 sensor devices can be placed on this system. If it is desired that the sensor device report more than a simple on/off condition, then it will be necessary to provide multiple set bits for each sensor device, thereby decreasing the number of sensor devices which can be supported. Registers 17–48 are reserved for the display unit. The use of the registers dedicated to the display unit is different from that as described in relation to the sensor units and is not part of the present invention. Therefore, it will not be discussed in further detail herein. Eight more registers, 49–56, are dedicated to the output units. Therefore, this system can support up to 128 output devices. As shown in FIG. 4, a further block of memory, including registers 59–63, is dedicated for use with an alphanumeric printer. Registers 57 and 58 are reserved for supervisory functions and are not important to a proper understanding of the present invention.

Since instructions from the central processing unit sent over the data bus reach all peripheral units, including sensor units, output units, and display units, each EEPROM in a peripheral device, regardless of the type of device, responds to all instructions from the processing unit. Therefore, all EEPROMs have zeros in all bit positions other than the set bit or bits, including the bits in the memory blocks dedicated to other types of peripheral devices.

Figure 6:
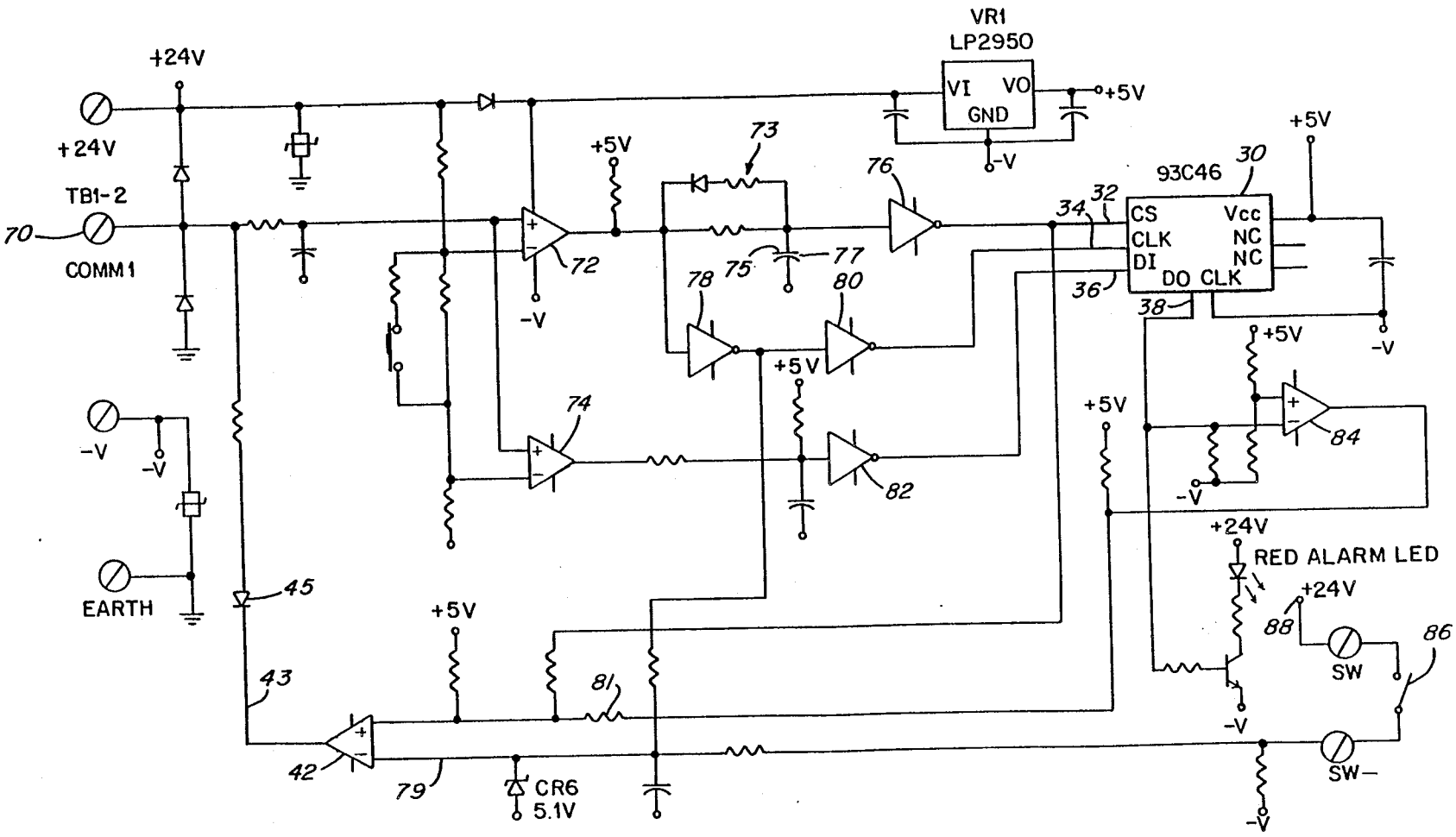
FIG. 6 shows a detailed circuit diagram of a preferred embodiment of a sensor unit of the present invention.

FIG. 6 shows a detailed circuit diagram of one of the preferred embodiments of the sensor unit of the present invention. The sensor unit is coupled to the data bus at node 70. The coded data from the processing unit is received at the input of operational amplifiers 72 and 74. Operational amplifier 72 extracts the clock signal from the bus. The output of operational amplifier 72 is placed at the input of operational amplifier 76 through circuitry 73, which produces a negative steady state voltage at anode 75 of capacitor 77. Inverter 76 produces a positive voltage chip select signal therefrom and places it at the chip select pin 32 of EEPROM 30 so as to enable the EEPROM for the duration of the clock pulse train. The output of amplifier 72 is further fed to the input of inverter 78. The inverted clock signal, which is the output of inverter 78, is fed to the inverting input of comparator 42 through line 79 so as to allow the sensing device to "report" only during the first half of the clock cycle as discussed in relation to FIG. 2. The output of inverter 78 is also fed into the input of inverter 80 so as to provide a corrected clock signal to the clock input pin 34 of the EEPROM 30. The data (e.g. start bit, op-code and address) is decoded by operational amplifiers 74 and 82. The output of operational amplifier 82 is coupled to the data-in pin 36 of EEPROM 30.

Figure 7:
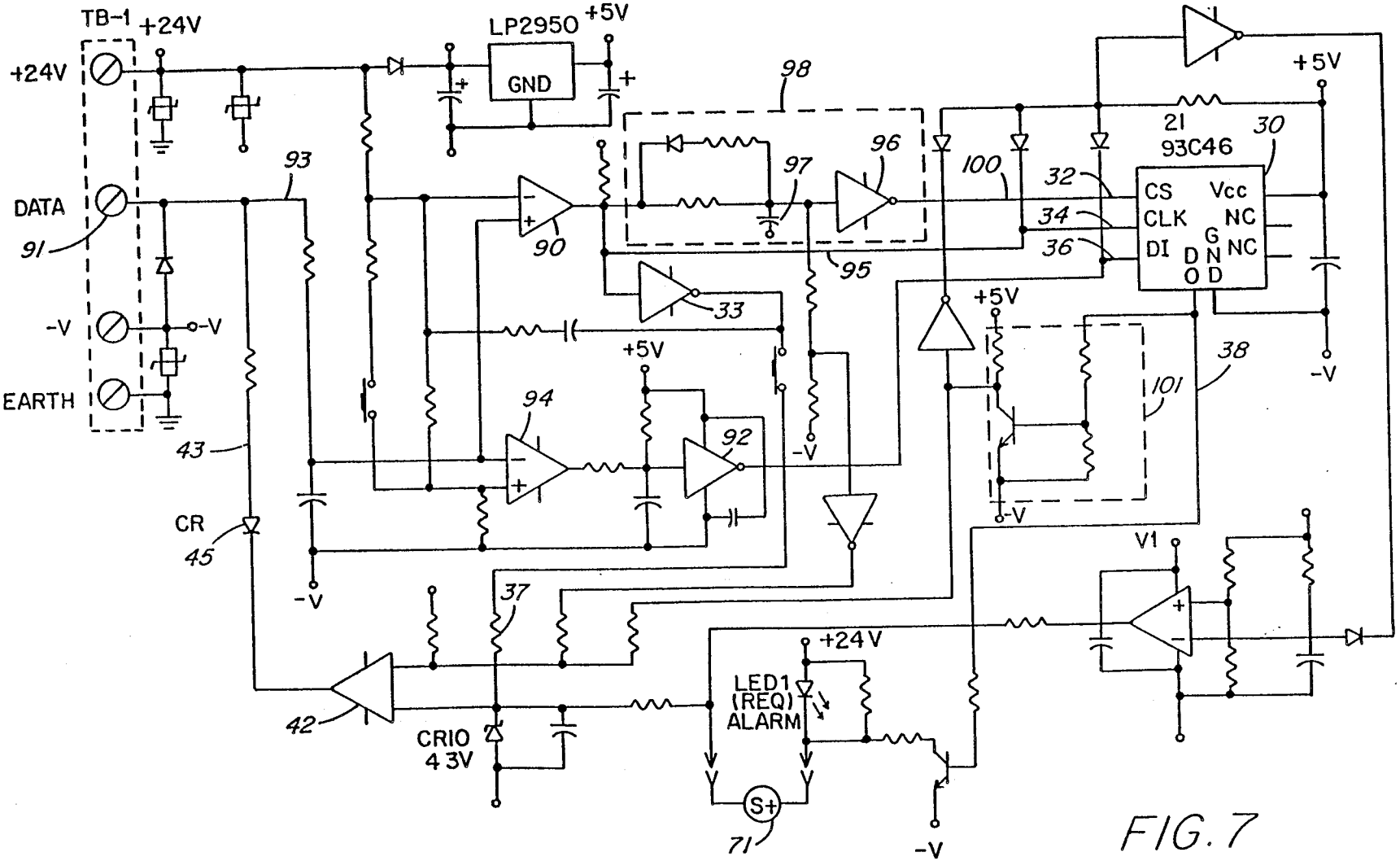
FIG. 7 shows a detailed circuit diagram of a preferred embodiment of a smoke detector sensor unit of the present invention.

The data-out pin 38 of EEPROM 30 is fed through operational amplifier 84 and other related circuitry to the non-inverting input of comparator 42. Resistor 81 holds the non-inverting input of comparator 42 at five volts until the data at data output pin 38 goes high as explained above in relation to FIG. 2. The inverting input of comparator 42 is coupled to one terminal of the sensing device which is shown in FIG. 7 as manually operated switch 86. The other terminal of the switch is coupled to a voltage source at 88. The output 43 of the comparator 42 is coupled to the data bus through diode 45.

FIG. 7 shows a detailed circuit diagram of another preferred embodiment of a sensor unit of the present invention; this one an addressable smoke detector. The sensor unit is coupled to the data bus at 91. The tri-level coded data from the processing unit is received at the input of operational amplifiers 90 and 94 through line 93. The clock and chip select signals are extracted from the output of operational amplifier 90. The output of operational 90 is fed directly to the clock input pin 34 of the EEPROM 30 through line 95. The circuitry contained in block 98 generates the chip select for the duration of the clock pulse train. A negative voltage is built up on capacitor 97 for the duration of the clock pulse train. The negative voltage on capacitor 97 is converted to a positive voltage by inverter 96 and provided to the chip select input pin 32 of EEPROM 30 on line 100. The data portion of the tri-state coded message from point 91 is detected by operational amplifier 94. The output of operational amplifier 94 is fed to the input of inverter 92. The output of inverter 92 is fed to the data in pin 36 of EEPROM 30.

The smoke detecting transducer 71 is coupled so as to cause a current to flow into the inverting input of comparator 42 when a specified level of smoke is detected. The non-inverting input of comparator 42 is coupled to the data out pin 38 of EEPROM 30 through circuitry block 101.

The output of operational amplifier 90, which is the clock signal, is also fed to the inverting input of comparator 42 through inverter 33 and resistor 37 as described in relation to FIG. 2.

The present invention will now be described in relation to the output unit protocol and particularly in relation to the sending of alarm condition data from the processing unit 12 to the output devices 18 (e.g. alarm, sprinkler) when the system is in the alarm mode. Referring again to FIG. 3, the multiplexed clock and data signal are shown in FIG. 3A. FIG. 3B shows the decoded clock signal, while FIG. 3C shows the chip select signal. FIG. 3D shows the decoded start bit 50 followed by the READ op-code 52 further followed by a six bit register address 54. All devices (including the sensor units and other peripherals) respond by serially providing the data stored in the specified register.

Figure 8:
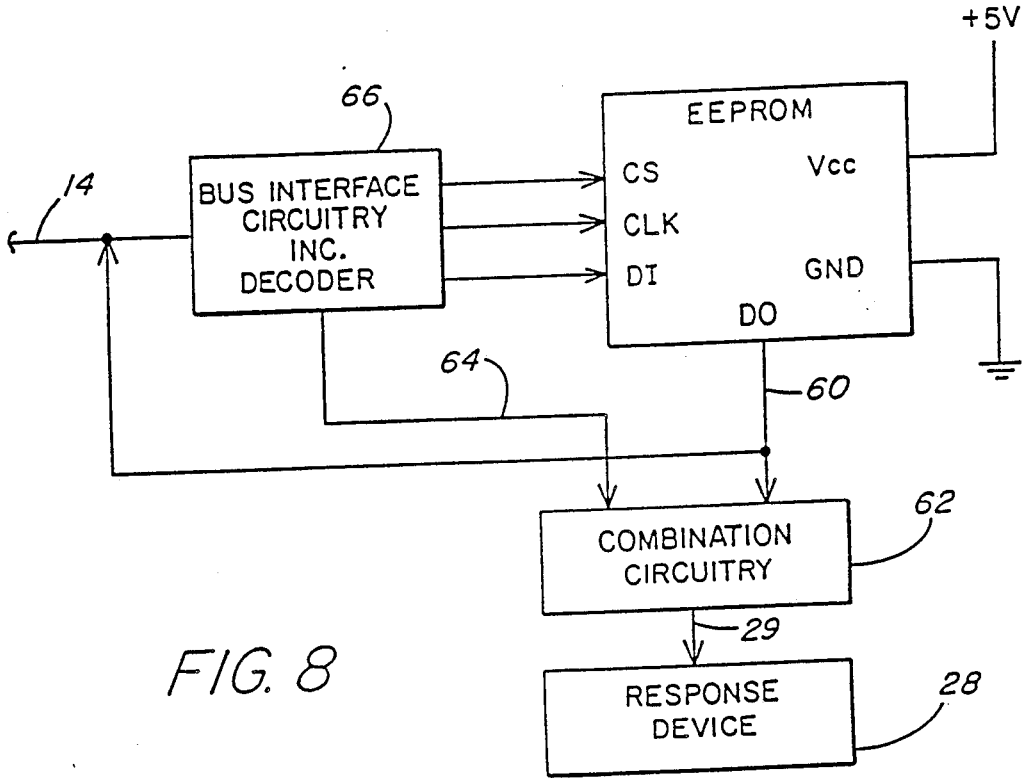
FIG. 8 shows a block diagram of an output unit of the present invention.

As shown in FIG. 8, the data-out line 60 of the EEPROMs in the output units 18 are coupled to the response device 28 (e.g. alarm, relay) through combination circuitry 62. Of course, the data-out line 60 of the EEPROMs is also coupled directly to the bus so that the output unit may be polled during the idle mode to determine if it is properly coupled to the bus as discussed above. The combination circuitry 62 is designed to output a voltage on line 29 to the response device 28 only if both the data on line 60 is high and the data on line 64 is high. The data on line 60 is the data read out of the EEPROM in response to a read instruction from the processing unit 12. This data should be a zero at all times except when the set bit is read out, at which time the data on line 60 is high for one clock cycle. The programming unit 12, knowing that it wishes to activate a particular response device, can send a pulse over bus 14 to all the devices coupled to the bus, the pulse being timed to correspond with the reading out of the set bit of the response device which it is desired to activated. In other words, any particular response device can be activated by the processing unit by first sending an op-code over the data bus instructing the EEPROMS to read out data and then sending a pulse over bus 14 to correspond with the reading out of the set bit of the response device which it is desired to activate. The interface circuitry 66 decodes the coded pulse on bus 14 and places it on line 64.

Figure 9:
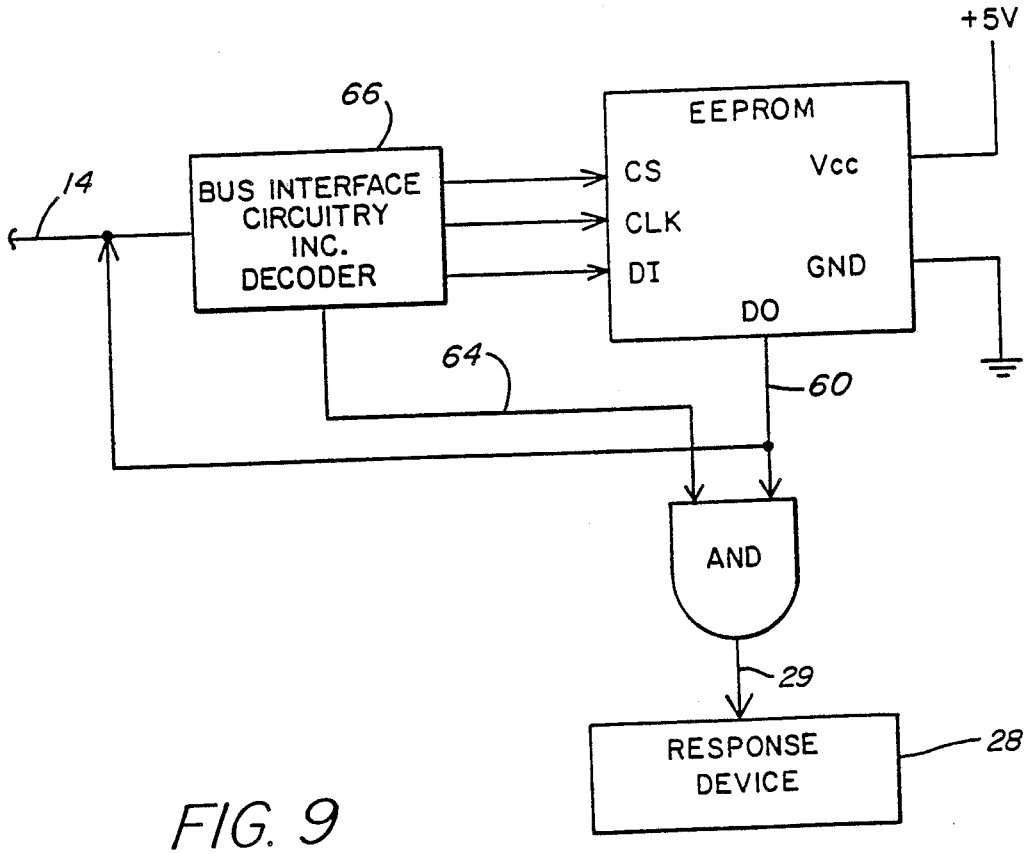
FIG. 9 shows a block diagram of a particular embodiment of an output unit of the present invention.

If it is desired to activate more than one response device, then the processing unit merely needs to send out more than one pulse at the appropriate times corresponding to the device addresses which are to be activated. If the response device 28 is merely a relay requiring a single bit of information signifying on or off, then the combination circuitry 62 may be a simple AND gate as shown in FIG. 9. However, as discussed in relation to the sensor units, the data-out from the EEPROM can be multi-bit data and contain qualitative or quantitative information in addition to a simple on/off indication in which case more complex combination circuitry would be required.

It should be noted that the block of memory reserved for the output devices need not necessarily be the same size as the block of memory reserved for the sensor units or even have a bit location reserved for each output unit. For instance, if several output units are to respond to the same sensor unit, then two or more output units would have the same bit location set so that they would both respond to an indication from the processing unit that a certain sensor unit is in an alarm condition. On the other hand, if one output device is intended to respond to any one of a group of sensor units, then the programming in the processing unit can be designed such that the pulse that is sent out which indicates the activated sensor corresponds to a group of sensor units. For example, if the sixth output unit is intended to respond to an alarm condition at sensor units 26, 27, 28 and/or 29, then the programming in the processing unit 12 can be adapted to output a single pulse which indicates that one or more of units 26, 27, 28 or 29 are in an alarm state. That single pulse could activate one (or even more than one) of the output units. Additionally, data-out from the EEPROM on line 60 need not be a single bit and can be a multi-bit signal indicating to the response device qualitative or quantitative information about the sensor conditions.

Having thus described a few particular embodiments of the invention, various alterations, modifications and improvements will readily occur to those skilled in the art. For instance, the clock signal, chip select signal and data signal from the processing unit need not be multiplexed on a single line and may be provided to the peripheral units on separate lines. Additionally, there is no requirement that the EEPROM operate in a serial manner. Serial operation, however, is the preferred method since it requires less wiring and simpler interfaces between the bus and the peripheral devices. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A control system having a central processing unit coupled via a bus to a series of peripheral devices, the processing unit adapted to receive data from a first group of the peripheral devices, termed sensor units, and responding to the data received therefrom, comprising:

an Electronically Erasable Programmable Read Only Memory (EEPROM) associated with each sensor unit coupled to the bus, the EEPROM having a plurality of memory locations and programmed so as to respond to instructions in the form of binary op-codes sent over the bus from the processing unit to the sensor units;

the EEPROM programmed with zeros in all memory locations except for an identifying code in a section of memory unique to each EEPROM;

means within the processing unit for sending a read instruction to the EEPROMs over the bus; and means within the processing unit for reading the data placed on the bus by the EEPROMs in response to a read instruction in order to determine which of said sensor units responded to the read instruction.

2. A control system as set forth in claim 1 further comprising:

means at each sensor unit for receiving data from an external source;

means for combining the external data with the identifying code from the associated EEPROM such that the external data is placed on the bus only simultaneously with the reading out of the identifying code of the associated EEPROM; and means within the processing unit for separating the external information from the identifying code when received over the bus.

3. A control system as set forth in claim 2 further comprising:

a second group of peripheral devices coupled to the bus, termed output units;

the output units each having an EEPROM associated therewith, each EEPROM programmed with zeros in all memory locations except for an identifying code stored in a section of memory unique to each EEPROM;

means within the processing unit for selecting an output unit to respond to an alarm condition at a sensor unit;

means within the processing unit for sending response instructions to the output units in response to the external information received from the sensor units simultaneously with the reading out of the identifying code of the output unit which is to respond to the alarm condition;

a response device associated with each output unit for responding to response instruction from the processing unit; and means within the output units for enabling the output unit to respond to response instructions from the processing unit only simultaneously with the identifying code of the associated EEPROM being read out of the EEPROM.

4. A control system as set forth in claim 3 wherein the identifying code is a single bit set to 1.

5. A control system as set forth in claim 3 wherein the identifying code is a series of bits set to 1.

6. A control system as set forth in claim 3 wherein the means for combining the external information with the identifying code comprises a comparator having first and second inputs and an output, the first input being coupled to receive the external information, the second input being coupled to receive the identifying code and the output being coupled to the bus.

7. A control system as set forth in claim 6 wherein the second input of the comparator is further coupled to a clock signal comprising a train of clock cycles, each cycle comprising a first level and a second level, the first and second levels selected so as to (i) prevent the comparator from drawing a current from the bus when the data at the first input of the comparator is in the second state, (ii) cause the comparator to draw a current from the bus when the data at the first input of the comparator is in the first state and the clock signal is in the first state, and (iii) when the data at the first input is in the first state and the clock signal is in the second state, cause the comparator to draw a current from the bus, if the external data is in the first state, and prevent the comparator from drawing current from the bus, if the external data is in the second state.

8. A control system as set forth in claim 6 wherein the external information is a single bit indicating ON or OFF condition.

9. A control system as set forth in claim 8 wherein the response instruction is a single bit which instructs the response device to activate if in a first state and instructs the response device to remain inactive if in a second state.

10. A control system as set forth in claim 9 wherein the means for enabling the response device only simultaneously with the reading out of the identifying code of the associated EEPROM comprises an AND gate having first and second inputs and an output, the first input being coupled to receive the data supplied from the associated EEPROM in response to a READ instruction, the second input coupled to receive the response instruction from the processing unit, and the output coupled to activate the response device if both inputs are in the second state.

11. A sensor unit for use in an alarm control system wherein a plurality of sensor units are coupled to a central processing unit via a data bus such that the processing unit may poll each sensor unit to determine its status, comprising:

an EEPROM having a single bit of memory set to a first state and all other memory locations set to a second state, the location of the bit set to the first state being different from every other sensor unit coupled to said control system;

a sensing device having an output which is in a first state when deactivated and in a second state when activated;

circuit means for allowing the EEPROM to be coupled to the bus to receive read instructions from the processing unit;

a comparator having first and second input and an output, the first input coupled to the data output pin of the EEPROM, and the second input coupled to the output of the sensing device;

a diode having an anode coupled to the comparator output and a cathode coupled to the bus such that current flow out of the comparator is inhibited; and the second input of the comparator further coupled to a clock signal comprising a train of clock cycles, each cycle comprising a first level and a second level, the first and second levels selected so as to (i) prevent the comparator from drawing a current from the bus when the data at the first input of the comparator is in the second state, (ii) cause the comparator to draw a current from the bus when the data at the first input of the comparator is in the first state and the clock signal is in the first state, and (iii) when the data at the first input is in the first state and the clock signal is in the second state, cause the comparator to draw a current from the bus, if the external data is in the first state, and prevent the comparator from drawing current from the bus, if the external data as in the second state.

12. An output unit for use in an alarm control system wherein a plurality of output units are coupled to a central processing unit via a data bus such that the processing unit may selectively activate the output units by issuing a timed pulse on the data bus at a specified time, comprising:

an EEPROM having a single bit memory location set to a first state and all other memory locations set to a second state;

circuit means for coupling the EEPROM to the data bus to receive read instructions and the timed pulse from the processing unit;

a response device having an input, the response device being de-activated when the input is in a first state and activated when in a second state; and an AND-gate having first and second inputs and an output, the first input coupled to the data-out pin of the EEPROM, the second input coupled to receive the clock pulse from the processing unit and the output coupled to the input of the response device.

13. An alarm system including a central control unit and a plurality of sensor units and including a bus means for intercoupling the central control unit and plurality of sensor units, each of said sensors including a programmable memory means having a plurality of memory locations with at least one memory location of each programmable memory means being set to a first state while all other memory locations other than the at least one set to the first state, being set to a second state, said at least one memory location which are set to the first state being selected such that no two sensor units have corresponding memory locations set to the first state, said central control unit including means for sending a read instruction to the programmable memory means over the bus means, and means for reading the data placed on the bus means from the programmable memory means in response to the read instruction in order to determine which sensor units responded to the read instruction.

14. An alarm system as set forth in claim 13 wherein the means for sending a read instruction includes means for sending a binary op-code, readable by the programmable memory means, over the bus means from the central control unit to the plurality of sensor units.

15. An alarm system as set forth in claim 13 wherein said programmable memory means comprises an electronically erasable programmable read only memory.

16. An alarm system as set forth in claim 13 wherein said first state is a binary "one" state and said second state is a binary "zero" state.

17. An alarm system as set forth in claim 13 wherein only a single bit of memory in each memory mean is set to the first state.

18. An alarm system as set forth in claim 13 wherein each sensor unit further comprises means for receiving data from an external source, means for combining the external data with the data read from the associated memory means before it is placed on the bus means such that the external data does not affect the bus mean when the data read from the associated memory means is in the second state and the external data does affect the bus means when the data read from the associated memory means is in the first state, and means within the central control unit for separating the external information from the data read from the associated memory means when received over the bus means.

19. An alarm system as set forth in claim 18 wherein the means for combining the external information with the identifying code comprises a comparator having first and second inputs and an output, the first input being coupled to receive the external information, the second input being coupled to receive the data from the associated memory means, and the output being coupled to the bus means.

20. An alarm system as set forth in claim 18 further comprising a plurality of output units, the output units each having an EEPROM with multiple memory locations associated therewith, each EEPROM having at least one memory location set to the first state and all memory location other than the at least one set to the first state being set to a second state, the at least one memory location to the first state in one output unit EEPROM being different than the at least one memory location set to the first state in any other output unit EEPROM and sensor unit memory means.

21. An alarm system as set forth in claim 18 wherein; the second input of the comparator is further coupled to a clock signal comprising a train of clock cycles, each cycle comprising a first level and a second level, the first and second levels selected so as to (i) prevent the comparator from drawing a current from the bus when the data at the first input of the comparator is in the second state, (ii) cause the comparator to draw a current from the bus when the data at the first input of the comparator is in the first state and the clock signal is in the first state, and (iii) when the data at the first input is in the first state and the clock signal is in the second state, cause the comparator to draw a current from the bus, if the external data is in the first state, and prevent the comparator from drawing current from the bus, if the external data as in the second state.

22. An alarm system as set forth in claim 21 wherein said central control unit further comprises means for sending READ instructions over the bus means to the output unit EEPROMs, and mean for reading the data placed on the bus means from the output unit EEPROMs in response to the read instructions.

23. An alarm system as set forth in claim 22 further including means within the central control unit for selecting one or more output units to respond to an alarm condition at a sensor unit, means within the central control unit responsive to the external information received from the sensor units for sending response instructions to the output units simultaneously with the reading out of the identifying code of the output unit which is to be activated, a response device associated with each output unit for responding to response instructions from the central control unit, and means within the output units for enabling the output unit to respond to response instructions from the central control unit only simultaneously with the reading out of the identifying code of the EEPROM associated with that output unit.

24. An alarm system as set forth in claim 23 wherein the external information is a single bit indicating an "on" condition if in a first state and an "off" condition if in a second state.

25. An alarm system as set forth in claim 24 wherein the response instruction is a single bit which instructs the response device to activate if in a first state and instructs the response device to remain inactive if in a second state.

26. An alarm system as set forth in claim 25 wherein the means for enabling the response device only simultaneously with the reading out of the identifying code of the associated EEPROM comprises an AND gate having first and second inputs and an output, the first input being coupled to receive the data supplied from the associated EEPROM in response to a READ instruction, the second input coupled to receive the response instruction from the processing unit, and the output coupled to activate the response device if both units are in the second state.

27. A control system comprising;

a plurality of output devices, a central processing unit for controlling said output devices, a bus coupling said output devices and said central processing unit together, each output device comprising a memory storage device having a plurality of storage locations, at least one of said storage locations in each memory device set to a first state such that each memory storage device has a different at least one storage location set to the first state and all other storage locations set to a second state, said memory storage device having an input for receiving instructions from said bus and an output for outputting data stored in said storage locations, means within said processing unit for issuing an instruction over said bus to said output devices, means within said processing unit for issuing a pulse on said data bus, at a specified time, and means associated with each output device, responsive to the simultaneous occurrence of said pulse on said bus and said memory storage device output being in said first state, for generating an output signal.

28. A control system comprising;

a plurality of sensor devices, a central processing unit for polling said sensor devices, a bus coupling said sensor devices and said central processing unit together, each sensor unit comprising a sensing device having an output which is in a first state when a specified condition is sensed and in a second state when said specified condition is not sensed, each of said sensor units further comprising programmable memory storage means having a plurality of storage locations, at least one of said storage locations set to a first state such that each memory storage means has a different at least one memory location set to said first state and all other memory locations set to a second state, means within said central processing unit for causing said programmable memory storage means to write data onto said bus, and means within said central processing unit for determining which sensor unit responded to said instruction by determining which programmable memory storage means output data from said storage location set to said first state.

29. A control system as set forth in claim 28 further comprising;

means associated with each sensor unit for combining the output of said sensing device with the output of the associated memory storage means such that the output of said sensing device is inhibited from affecting the bus at all times except simultaneously with the output from said associated memory storage means of said at least one storage location set to said first state.

* * * * *